US006228573B1

(12) United States Patent
Keevert, Jr. et al.

(10) Patent No.: US 6,228,573 B1
(45) Date of Patent: May 8, 2001

(54) PROCESS FOR THE PREPARATION OF HIGH BROMIDE ULTRATHIN TABULAR GRAIN EMULSIONS

(75) Inventors: John E. Keevert, Jr.; Joe E. Maskasky; Michael G. Antoniades, all of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/464,468

(22) Filed: Dec. 15, 1999

(51) Int. Cl.[7] ..... G03C 1/005; G03C 1/494
(52) U.S. Cl. ..... 430/569; 430/567
(58) Field of Search ..... 430/567, 569

(56) References Cited

U.S. PATENT DOCUMENTS

| | | |
|---|---|---|
| 4,414,310 | 11/1983 | Daubendiek et al. . |
| 4,433,048 | 2/1984 | Solberg et al. . |
| 4,434,226 | 2/1984 | Wilgus et al. . |
| 4,439,520 | 3/1984 | Kofron et al. . |
| 4,713,320 | 12/1987 | Maskasky . |
| 4,914,014 | 4/1990 | Daubendiek et al. . |
| 5,217,858 | 6/1993 | Maskasky . |
| 5,250,403 | 10/1993 | Antoniades et al. . |
| 5,372,927 | 12/1994 | Delton . |
| 5,411,851 | 5/1995 | Maskasky . |
| 5,612,175 | 3/1997 | Eshelman et al. . |
| 5,612,176 | 3/1997 | Eshelman et al. . |

FOREIGN PATENT DOCUMENTS

| | | |
|---|---|---|
| 362 699 | 4/1990 | (EP) . |
| 503 700 | 9/1992 | (EP) . |
| 735 413 | 10/1996 | (EP) . |

*Primary Examiner*—Geraldine Letscher
(74) *Attorney, Agent, or Firm*—Andrew J. Anderson

(57) ABSTRACT

A process for preparing an ultrathin high bromide {111} tabular grain silver halide emulsion in a reaction vessel comprising the steps of (a) forming in the presence of a dispersing medium a population of silver halide grain nuclei containing twin planes, and (b) growing the silver halide grain nuclei containing twin planes to form high bromide {111} tabular silver halide grains by the addition of silver and halide ions, WHEREIN the majority of the silver added during growth step (b) is added at a pBr of less than 2.6 and in the presence of a triaminopyrimidine grain growth modifier containing mutually independent 4, 5 and 6 ring position amino substituents, the 4 and 6 ring position substituents being hydroamino substituents. High bromide ultrathin {111} tabular grain emulsions prepared by the process of the invention provide thinner tabular grains than that obtained in the absence of the triaminopyrimidine grain growth modifier. Additionally, the double jet process of the invention is highly controllable and commercially scalable.

20 Claims, No Drawings

PROCESS FOR THE PREPARATION OF HIGH BROMIDE ULTRATHIN TABULAR GRAIN EMULSIONS

FIELD OF THE INVENTION

The invention relates to a process for preparing ultrathin high bromide tabular grain emulsions for photographic use, wherein a triaminopyrimadine grain growth modifier is used.

BACKGROUND OF THE INVENTION

The term "tabular grain" is employed to indicate a silver halide grain having an aspect ratio of at least 2, where "aspect ratio" is ECD/t, ECD being the equivalent circular diameter of the grain (the diameter of a circle having the same projected area as the grain) and t is the thickness of the grain.

The term "ultrathin tabular grain" is employed to indicate a tabular grain of a thickness less than 0.07 $\mu$m.

The term "tabular grain emulsion" is employed to indicate an emulsion in which tabular grains account for at least 50 percent of total grain projected area.

The term "high chloride" or "high bromide" as applied to a grain or emulsion is employed to indicate that the grain or the grains of the emulsions contain at least 50 mole percent chloride or bromide, respectively, based on total silver present in the grain or the grains of the emulsion.

The term "{111} tabular grain" is employed to indicate an emulsion in which the parallel major faces of the tabular grain lie in {111} crystal planes.

The overwhelming majority of photographic applications currently employing high aspect ratio (e.g., >8) tabular grain emulsions are served by those emulsions in which the tabular grains contain at least 50 mole percent bromide, based on total silver. Iodide in varying amounts occasionally ranging up the saturation level of iodide in the silver bromide crystal lattice (approximately 40 mole percent) are often incorporated into the tabular grains to enhance photographic sensitivity. Wilgus et al U.S. Pat. No. 4,434,226, Solberg et al U.S. Pat. No. 4,433,048 and Kofron et al U.S. Pat. No. 4,439,520 disclose representative high aspect ratio tabular grain silver bromide and iodobromide emulsions. (In mixed halide grains the halides are named in order of ascending concentrations.)

In precipitating thin tabular grain silver bromide and bromoiodide emulsions, it is recognized that the bromide ion concentration in solution at the stage of grain formation must be maintained within limits to achieve the desired tabularity of grains. As grain growth continues, the bromide ion concentration in solution becomes progressively less influential on the grain shape ultimately achieved. For example, Wilgus et al U.S. Pat. No. 4,434,226 teaches the precipitation of high aspect ratio tabular grain silver bromoiodide emulsions at bromide ion concentrations in the pBr range of from 0.6 to 1.6 during grain nucleation, with the pBr range being expanded to 0.6 to 2.2 during subsequent grain growth. Kofron et al U.S. Pat. No. 4,439,520 extends these teachings to the precipitation of high aspect ratio tabular grain silver bromide emulsions. pBr is defined as the negative log of the solution bromide ion concentration. Daubendiek et al U.S. Pat. No. 4,414,310 describes a process for the preparation of high aspect ratio silver bromoiodide emulsions under pBr conditions not exceeding the value of 1.64 during grain nucleation. According to Maskasky U.S. Pat. No. 4,713,320, in the preparation of high aspect ratio silver halide emulsions the useful pBr range during nucleation can be extended to a value of 2.4 when the precipitation of the tabular silver bromide or bromoiodide grains occurs in the presence of gelatino-peptizer containing less than 30 micromoles of methionine (e.g., oxidized gelatin) per gram.

High chloride ultrathin {111} tabular grain emulsions are disclosed in Maskasky U.S. Pat. No. 5,217,858, wherein triaminopyrimidine grain growth modifiers are used in the preparation thereof containing 4, 5 and 6 ring position amino substituents, with the 4 and 6 position substituents being hydroamino substituents. The term "hydroamino" designates an amino group containing at least one hydrogen substituent—i.e., a primary or secondary amino group. The triaminopyrimidine grain growth modifiers include both those in which the three amino groups are independent (e.g., 4,5,6-triaminopyrimidine) and those in which the 5 position amino group shares a substituent with 4 or 6 position amino group to produce a bicyclic compound (e.g., adenine, 8-azaadenine, or 4-amino-7,8-dihydro-pteridine). High chloride {111} tabular grains, unlike high bromide {111} tabular grains, cannot be formed or maintained in the absence of a grain growth modifier, but rather would take nontabular forms, since {100} crystal faces are more stable in high chloride grains. The high chloride ultrathin {111} tabular grain emulsions are prepared by a double jet process in which silver and halide ions are concurrently run into a dispersing medium containing the grain growth modifier. The first function of the grain growth modifier is to promote twinning while grain nucleation is occurring, so that ultrathin grains can form. Thereafter the same grain growth modifier or another conventional grain growth modifier can be used to stabilize the {111} major faces of the high chloride tabular grains.

The art has long recognized that distinctly different techniques are required for preparing high chloride {111} tabular grain emulsions and high bromide {111} tabular grain emulsions. For example, U.S. Pat. No. 5,217,858 does not disclose the processes of preparing high chloride ultrathin {111} tabular grain emulsions to be applicable to the preparation of high bromide ultrathin {111} tabular grain emulsions. Further, since at low pBr the {111} major faces of high bromide tabular grains have no tendency to revert to {100} crystal faces, the precipitation of high bromide {111} tabular grain emulsions generally has not required the addition of compounds comparable to the grain growth modifiers of U.S. Pat. No. 5,217,858. Daubendiek et al U.S. Pat. No. 4,914,014, Antoniades et al U.S. Pat. No. 5,250,403 and Zola et al EPO 0 362 699 illustrate the preparation of high bromide ultrathin {111} tabular grain emulsions wherein silver and bromide are introduced into a reaction vessel during growth of the high bromide tabular grains. None of such references, however, suggest the use of a grain growth modifier to prepare high bromide ultrathin {111} tabular grain emulsions.

Verbeeck EPO 0 503 700 discloses reduction of the coefficient of variation (COV) of high bromide high aspect ratio {111} tabular grain emulsions through the presence of an aminoazaindene, such as adenine, 4-aminopyrazolopyrimidine and substitutional derivatives, prior to the precipitation of 50 percent of the silver. Double jet precipitation techniques are employed. The minimum disclosed thickness of a tabular grain population is 0.15 $\mu$m.

Maskasky U.S. Pat. No. 5,411,851 discloses the preparation of high bromide ultrathin tabular grain emulsions wherein a triaminopyrimidine grain growth modifier of the type described in U.S. Pat. No. 5,217,858 is used during a grain growth process which comprises ripening of seed grains as opposed to growth of grains by addition of silver and halide in a double jet process. U.S. Pat. No. 5,411,851 discloses that pBr for such ripening grain growth process is optimally greater than 2.6, and states that the grain growth modifiers were ineffective in producing ultrathin {111} tabular grain emulsions during a double jet precipitation process. Ripening grain growth processes, however, are generally hard to reproducibly control and commercially scale-up.

SUMMARY OF THE INVENTION

In one aspect the invention is directed to a process for preparing an ultrathin high bromide {111} tabular grain silver halide emulsion in a reaction vessel comprising the steps of (a) forming in the presence of a dispersing medium a population of silver halide grain nuclei containing twin planes, and (b) growing the silver halide grain nuclei containing twin planes to form high bromide {111} tabular silver halide grains by the addition of silver and halide ions, WHEREIN the majority of the silver added during growth step (b) is added at a pBr of less than 2.6 and in the presence of a triaminopyrimidine grain growth modifier containing mutually independent 4, 5 and 6 ring position amino substituents, the 4 and 6 ring position substituents being hydroamino substituents.

The high bromide ultrathin {111} tabular grain emulsions prepared by the process of the invention included in the Examples below report thinner tabular grains than that obtained in the absence of the triaminopyrimidine grain growth modifier. Thus, insofar as the quality of the grain population produced is concerned, the process of the invention compares favorably with prior processes for preparing high bromide ultrathin {111} tabular grain emulsions. Additionally, the double jet process of the invention is highly controllable and commercially scalable.

DESCRIPTION OF PREFERRED EMBODIMENTS

This invention is directed to an improved process for the preparation of an ultrathin tabular grain emulsion containing high bromide tabular grains. As employed herein the term "high bromide" indicates a bromide content of at least 50 mole percent, based on total silver. Preferably, the high bromide tabular grains contain at least 80 mole percent bromide, based on total silver. Remaining halide concentrations may comprise iodide and/or chloride.

The process of the invention comprises a nucleation step and a subsequent growth step. As is well recognized in the art the nucleation of high bromide tabular grains is preferably accomplished by the formation of silver bromide grain nuclei containing parallel twin planes. The concentration of silver halide grain nuclei formed in a double jet process prior to actual grain growth is usually less than 0.6, and typically less than 0.1, percent by weight silver in the dispersing medium. While Wilgus et al, Kofron et al and Solberg et al, cited above and here incorporated by reference, teach iodide ion is preferably excluded during grain nucleation as the presence of such iodide may result in a tendency to thicken formed tabular grains, iodide may be present during nucleation for ultrathin emulsion grains prepared in accordance with the invention. The presence of chloride ion during nucleation does not thicken the tabular grains formed, but it does alter grain nucleation sufficiently that grain nucleation optimizations empirically developed for bromide ion can be no more than coincidentally optimum when chloride is also present.

The nucleation step of emulsion precipitation is generally understood to extend over that portion of the precipitation in which the tabular grain nuclei are being formed—that is, a significant fraction of the silver being precipitated is being consumed in the formation of new grains rather than depositing on grains already in existence. While conditions can be controlled to continue grain nucleation over an extended period, in the interest of limiting grain size dispersity it is conventional practice to create a grain population and to cease grain nucleation while consuming a minimal fraction of total silver. It is generally preferred to complete nucleation prior to introduction of 2 percent of total silver, with efficient nucleating steps often consuming less than 1 percent or even less than 0.5 percent of total silver.

Following nucleation, high bromide {111} tabular grains are grown by the subsequent addition of silver and halide ions to a reaction vessel containing a population of nuclei in a dispersing medium. The reactants can be added to the reaction vessel in the form of solutions of silver and halide salts, or in the form of preformed silver halide nuclei or fine grains. To minimize the risk of elevated minimum densities in the emulsions prepared, it is common practice to prepare high bromide photographic emulsions with a slight stoichiometric excess of bromide ion present. At equilibrium the following relationship exists:

$$-\log K_{sp} = pBr + pAg \quad (I)$$

where $K_{sp}$ is the solubility product constant of silver bromide;

pBr is the negative logarithm of bromide ion activity; and pAg is the negative logarithm of silver ion activity.

The solubility product constant of silver bromide emulsions in the temperature range of from 0 to 100° C. has been published by Mees and James *The Theory of the Photographic Process*, 3th Ed., Macmillan, N.Y., 1966, page 6. The equivalence point, $pBr = pAg = -\log K_{sp} \div 2$, which is the point at which no stoichiometric excess of bromide ion is present in the aqueous dispersion, is known from the solubility product constant. By employing a reference electrode and a sensing electrode, such as a silver ion or bromide ion sensing electrode or both, it is possible to determine from the potential measurement of the aqueous dispersion its bromide ion content (pBr). Soluble bromide salt (e.g. alkali bromide) addition can be used to decrease pBr while soluble silver salt (e.g. silver nitrate) additions can be used to increase pBr.

In accordance with the process of the invention, the majority of the silver added during the growth step is added at a pBr of less than 2.6 and in the presence of a triaminopyrimidine grain growth modifier containing mutually independent 4, 5 and 6 ring position amino substituents, the 4 and 6 ring position substituents being hydroamino substituents. As employed herein the term "hydroamino" designates an amino group containing at least one hydrogen substituent—i.e., a primary or secondary amino group. The 5 position amino ring substituent can be a primary, secondary or tertiary amino group. In referring to the amino groups as "independent" it is meant that each amino group can be selected independently of the others and that no substituent of one amino group is shared with another amino group. In other words, substituents that bridge amino groups are excluded. Pyrimidine grain growth modifiers satisfying the above general description are herein referred to as "invention" grain growth modifiers.

In a specifically preferred form the grain growth modifier can satisfy the following formula:

(II)

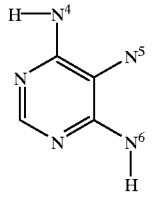

where $N^4$, $N^5$ and $N^6$ are independent amino moieties.

In the simplest contemplated form each of $N^4$, $N^5$ and $N^6$ can be a primary amino group (—$NH_2$). Any one or combination of $N^4$, $N^5$ and $N^6$ can be a primary amino group. Any one or combination of $N^4$, $N^5$ and $N^6$ can alternatively take the form of a secondary amino group (—NHR), where the substituent R is in each instance an independently chosen hydrocarbon containing from 1 to 7 carbon atoms. R is preferably an alkyl group—e.g., methyl, ethyl, n-propyl, i-propyl, n-butyl, i-butyl, t-butyl, etc., although other hydrocarbons, such as cyclohexyl or benzyl, are contemplated. To increase growth modifier solubility the hydrocarbon groups can, in turn, be substituted with polar groups, such as hydroxy, sulfonyl or amino groups, if desired, or the hydrocarbon can be substituted with other groups that do not materially affect their properties (e.g., a halo substituent). In another alternative form $N^5$ can, independently of $N^4$ and $N^6$, take the form of a tertiary amino group (—$NR_2$), where R is as previously defined.

In one specific form the grain growth modifiers used in the process of this invention satisfy the formula:

(III)

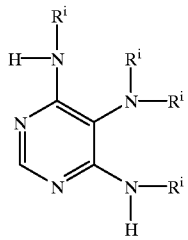

where $R^i$ is independently in each occurrence hydrogen or alkyl of from 1 to 6 carbon atoms.

The following are illustrations of varied pyrimidine compounds within the purview of the invention:

PY-1 4,5,6-Triaminopyrimidine

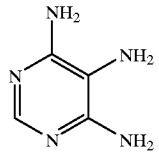

PY-2 5,6-Diamino-4-(N-methylamino)pyrimidine

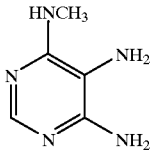

PY-3 4,5,6-Tri(N-methylamino)pyrimidine

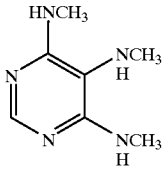

PY-4 4,6-Diamino-5-(N,N-dimethylamino)pyrimidine

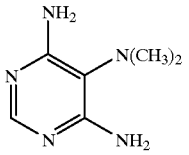

PY-5 4,6-Diamnino-5-(N-hexylamino)pyrimnidine

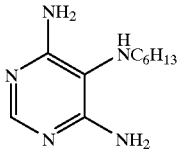

Contemplated concentrations of the grain growth modifier for use in the process of the invention range from 0.1 to 200 millimoles per final silver mole. A preferred grain growth modifier concentration is from 1 to 60 millimoles per silver mole, more preferably from 5 to 40 millimoles per silver mole, and most preferably from 10 to 35 millimoles per silver mole.

To maximize tabular grain thickness reduction, it is preferred that at least 80 percent of the grain growth is performed in the presence of the triaminopyrimidine grain growth modifier, while the pBr is maintained below 2.6, preferably between 1.5–2.6, and most preferably between 1.7–2.1. To maximize tabular grain percentages, however, it is also preferred to perform a short growth segment (e.g., addition of 0.1 to 20% of total silver, more preferably 1 to 15% and most preferably 4 to 10% of total silver) before addition of the majority of the grain growth modifier. Optimally, from 1 to 20 percent of the grain growth modifier is added before the short growth section, and the remainder is added after such short growth section but before the major portion of the growth step.

It is believed that the effectiveness of the grain growth modifier is attributable to its preferential absorption to {111} crystal faces and its ability to preclude additional silver halide deposition on these surfaces. While such grain growth modifiers are generally not required to form high bromide tabular grains, their use in accordance with the invention has been found to facilitate production of grains having average thicknesses of less than 0.04, and even less than 0.03, micrometers. With average grain ECD values for photographic applications being limited to less than 10 micrometers as an extreme and for the overwhelming majority of photographic applications to less than 5 micrometers, average aspect ratios of greater than 80 and even greater than 100 can be realized. The process of the present invention is capable of providing high bromide ultrathin {111} tabular grain emulsions having precisely selected mean ECD's. The emulsions can also exhibit high levels of grain uniformity. Attaining emulsions in which the tabular grains account for greater than 90 percent of total grain projected area have been realized.

The process of the present invention produces emulsions with tabular grain projected areas of greater than 50 percent. The preferred processes of the present invention produce tabular grain projected areas of at least 70 percent of total grain projected area and tabular grain projected areas can range up to 97 percent or more of total grain projected area. By employing the process of the present invention in combination with compatible processes of precipitation cited above (e.g., the process of Tsaur et al or Saitou et al) it is possible to improve upon the low thicknesses that these cited processes produce.

It is, of course, possible to add minor amounts of chloride and/or iodide ions during the growth step of the process of the invention. For example, if a chloride ion concentration at any level of up to (but not including) 50 mole percent is desired, this can be accommodated merely by increasing the levels of chloride ion introduced during precipitation as taught by Wey et al, U.S. Pat. No. 4,414,306.

Although not required to achieve the advantages of the invention, the incorporation of minor amounts of iodide into the high bromide tabular grains is preferred to obtain the highest achievable speed-granularity relationships (see Kofron et al for an extended explanation). Iodide can be incorporated into the high bromide tabular grains up to its solubility limit in the face centered cubic crystal lattice structure provided by bromide and chloride ions. Although iodide maximum incorporation can vary as a function of chloride ion concentrations and preparation temperatures, it is generally recognized that iodide inclusions of up to approximately 40 mole percent, based on total silver, are possible in a silver bromide crystal lattice structure. However, for photographic purposes substantially lower levels of iodide are preferred, with preferred iodide levels seldom exceeding 20 mole percent. In fact, speed-granularity relationship advantages can be largely realized with iodide concentrations as low as 0.5 mole percent. Higher iodide concentrations are nevertheless common to specific photographic applications to achieve varied effects, such as increased native sensitivity to blue light or to improve interimage effects in multicolor photographic elements. Since iodide ion release is known to retard the rate of emulsion development, it is generally preferred to employ iodide concentrations of less than 10 mole percent and preferably less than 5 mole percent, based on total silver. Iodide can be introduced during precipitation in any convenient conventional form. For example, iodide can be introduced as a soluble salt (e.g., ammonium, alkali or alkaline earth iodide) or as a Lippmann emulsion.

In addition to the features specifically discussed above the preparation of high bromide tabular grain emulsions according to the process of the present invention can take any convenient conventional form.

From the description above it is apparent that any conventional high bromide tabular grain nucleation step for producing high aspect ratio tabular grain emulsions in which the tabular grains contain parallel twin planes and have {111} major grain faces can be employed. Techniques for the tabular grain nucleation step are fully described by Wilgus et al, Kofron et al, Solberg et al and Piggin et al, all cited above and here incorporated by reference. Other teachings of useful nucleation steps of particular interest here incorporated by reference include:

Maskasky U.S. Pat. No. 4,713,320, which discloses precipitation in the presence of a low methionine gelatinopeptizer;

Tsaur et al U.S. Pat. No. 5,210,013, which discloses preparation of very low coefficient of variation tabular grain emulsions in the presence of selected polyalkylene oxides;

Antoniades et al U.S. Pat. No. 5,250,403, which discloses techniques for preparing ultrathin tabular grain emulsions as well as emulsions of extremely high (>97%) tabular grain projected areas;

Saitou et al U.S. Pat. No. 4,797,354, which discloses preparations of tabular grain emulsions containing a high proportion of tabular grains with hexagonal major faces;

Daubendiek et al U.S. Pat. No. 4,914,014, which discloses the nucleation of tabular grain emulsions at high pBr levels;

Zola et al published European patent application 0 362 699, which discloses preparations of high aspect ratio tabular grain emulsions with low coefficients of variation in relation to their ECD; and Delton U.S. Pat. No. 5,372,927 discloses preparation of high aspect ratio tabular grain high bromide emulsions which incorporate chloride ions to offset thickening attributable to grain growth at low pAg.

In addition to following the teachings of any one of the above patents for grain nucleation, their teaching can be followed also for performing any portion of the grain growth step that is consistent with the use of a grain growth modifier in accordance with the invention.

In addition to their grains the emulsions prepared by the process of this invention contain an aqueous dispersing medium. The dispersing medium can be maintained within conventional pH ranges for emulsion precipitation, typically in a pH range of from 2 to 7. The dispersing medium contains a peptizer to maintain dispersion of the grains. Any conventional hydrophilic colloid peptizer can be employed. A summary of such peptizers is included in Research Disclosure, Vol. 365, September 1994, Item 36544, Section II, sub-section A. Research Disclosure is published by Kenneth Mason Publications, Ltd., Dudley House, 12 North St., Emsworth, Hampshire P010 7DQ, England. Preferred peptizers are gelatino-peptizers, including those containing less than 30 micromoles of methionine (e.g., oxidized gelatin) per gram as disclosed in Maskasky U.S. Pat. No. 4,713,320, here incorporated by reference. Mignot U.S. Pat. No. 4,334,012, here incorporated by reference, discloses management of grain nucleation and growth to provide an optimum dispersing medium for precipitation.

Since the {111} major faces of high bromide {111} tabular grains are stable and do not require adsorbed species to avoid degradation to unwanted grain morphologies, the grain growth modifier of the invention can be removed following completion of the growth step of the invention process. The grain growth modifier of the invention can be removed by protonation. It is not necessary, but preferred for most photographic end uses, that the grain growth modifier be replaced on the {111} major faces of the tabular grains by another, photographically useful adsorbed compound, such as a spectral sensitizing dye. Protonation alone or protonation followed by adsorption of another photographically useful compound can be undertaken as disclosed by Maskasky U.S. Pat. No. 5,221,602, here incorporated by reference.

Apart from the features that have been specifically disclosed, preparation of emulsions in accordance with the invention, and photographic elements containing these emulsions, can take any convenient conventional form.

Conventional features are summarized in Research Disclosure, Vol. 365, September 1994, Item 36544, the disclosure of which is here incorporated by reference.

EXAMPLES

The invention can be better appreciated by reference to the following specific examples.

Example 1

(Preparation of ultra thin, high aspect ratio tabular grain AgBrI emulsion 1)

The making kettle contained 0.605 g NaBr per liter and 30 g oxidized, deionized alkali processed bone gel per liter, totaling 5.5 liters (pBr 2.27). The kettle was adjusted to pH 6.07 at 30° C.

Over the course of 6 seconds, 10 ml of 1.67 M $AgNO_3$ and 10 ml of 1.645 M NaBr with 0.025 M KI were simultaneously added, with vigorous mixing. The temperature was then increased to 60° C., and 17.9 g NaCl in 135 ml DW was added followed by 9.47 g NaBr in 92 ml (pBr 1.73).

The resulting pBr was maintained with NaBr solution while 675 ml of 0.4 M $AgNO_3$ and 81 ml of 0.05 M AgI seeds were added over 10 minutes.

A solution of 18.26 g 4,5,6-triaminopyrimidine sulfate, 34.7 g borax, and 20.4 g additional oxidized gel in 1291 ml was then added. The pH was adjusted to 7.0 at 60° C. and held constant.

Addition of $AgNO_3$ and AgI were restarted at half the earlier flow rate and the NaBr addition was controlled so that pBr was allowed to linearly rise to 2.02 over 7 minutes. Next the flow rate was increased until it was doubled after an additional 33 minutes, while maintaining pBr at 2.02. The flow rate was further increased over the next 46 minutes such that a total of 3.45 moles of $AgNO_3$ have been added to the kettle.

The resultant AgBrI emulsion was 1.5 mole % iodide. The tabular grain population made up over 90% of the total projected area of the emulsion grains. The median diameter of the projected-area-weighted distribution was 4.02 micrometers. The average thickness determined from measurement of grain edges on scanning electron micrographs at 80,000× is 0.035 micrometers. This gave an aspect ratio of 115.

Example 2

(Preparation of an ultrathin AgBrI emulsion 2 made using low molecular weight, oxidized gelatino-peptizer).

This make used a low pH treatment to reduce the molecular weight of the gel to enable nucleation at 20° C. The kettle contained 17.1 g oxidized, deionized alkali processed bone gel per liter, and 0.69 g NaBr per liter, totaling 1.8 L. (pBr 2.21). At 80° C., 0.032 moles of $HNO_3$ was added. After 55 minutes at 80° C. the temperature was reduced to 20C and the pH readjusted to 5.9.

Over the course of 9 seconds, 5.0 ml of a solution of 1.67 M $AgNO_3$ and 5.0 ml of a solution of 1.645 M NaBr and 0.025 M KI were simultaneously added, with vigorous stirring. The temperature was then increased to 35° C. and a solution of 5.4 g of oxidized, deionized gel in 100 ml was added. The temperature was increased to 50° C. and a solution containing 0.6 g 4,5,6-triaminopyrimidine sulfate and 0.7 g borax in 40 ml water was added, followed by a solution containing 5.97 g NaCl in 54 ml DW and another solution containing 3.81 g NaBr in 37 ml (pBr 1.71).

The resulting pBr was maintained with 4.5 M NaBr solution while 125 ml of 0.4 M $AgNO_3$ and 15 ml of 0.05 M AgI seeds were uniformly added over 5 minutes.

Next was added 300 ml of an aqueous solution containing 5.4 g 4,5,6-triaminopyrimidine sulfate, 8 g borax, 6.66 g oxidized, deionized gel, and 0.71 g NaBr. The pH was adjusted to 7.2 and held constant.

Over the next 20 minutes, 320 ml of 0.4 M $AgNO_3$ and 38 ml of 0.05 M AgI seeds were added at constant flow rate, again with sufficient 4.5 M NaBr to maintain pBr 1.71. The flow rate was then steadily increased over 69 minutes, until a total of 1.08 moles of $AgNO_3$ have been added to the kettle.

The resulting AgBrI emulsion is 1.5 mole % iodide. The tabular grain population made up over 85% of the total projected area of the emulsion grains. The median diameter of the projected-area-weighted distribution was 2.83 micrometers. The average thickness determined from measurement of grain edges on scanning electron micrographs at 80,000× was 0.0256 micrometers. The aspect ratio was 111.

Example 3

(A repeat make of Emulsion 2)

The emulsion make described for emulsion 2 was repeated, and the resultant emulsion 3 again had a tabular grain population that made up over 85% of the total projected area of the emulsion grains. It was examined by atomic force microscopy, and a tabular grain thickness of 0.0299 micrometer was observed, after correcting for a 0.005 micrometer thickness surface layer of oxidized gel. The area weighted diameter was 2.7 micrometers. This gave an aspect ratio of 90.

Example 4

(Preparation of ultrathin AgBr emulsion 4 made with PY-1 and low molecular weight gelatin).

Example emulsion 4 was made similar to example 2 except that the nucleation salt solution was 1.67 molar NaBr and no KI was added. No AgI seeds were added. This gave a pure AgBr emulsion. The tabular grain population made up over 90% of the total projected area of the emulsion grains. The tabular grains had a mean thickness of 0.0252 micrometers as measured by scanning electron micrographs at 80,000×. The area weighted diameter was 3.02 micrometers and the aspect ratio was 120.

Comparison Example 5

This control emulsion represents an example optimized in the absence of triaminopyrimidine, similar to the high bromide tabular grain emulsion make teachings of U.S. Pat. No. 5,612,175.

The make started with a kettle with 0.605 g NaBr per liter and 30 g oxidized, deionized alkali processed bone gel per liter, totaling 4.0 liters. The kettle was adjusted to pH 6.07 at 30° C. and the pBr was 2.27.

Over the course of 6 seconds, 10 ml of a solution of 1.67 M $AgNO_3$ and 10 ml of a solution of 1.645 M NaBr and 0.025 M KI were simultaneously added, with vigorous stirring. A solution of 20 g of oxidized, deionized gel in 1.0 L water was then added. The temperature was then increased to 60° C., pH was adjusted to 5.85, and a solution of 17.5 g NaCl in 132 ml was added followed by a solution of 9.06 g NaBr in 88 ml water (pBr of 1.75).

The resulting pBr was maintained with 4.5 M NaBr solution while 1320 ml of 0.4 M $AgNO_3$ and 158 ml of 0.05 M AgI seeds were added uniformly over 20 minutes.

Next, sufficient NaBr was added to bring pBr to 1.50, and growth was resumed at the same flow rate which gradually increased over 60 minutes, such that a total of 4.04 moles of $AgNO_3$ was added. This produced an AgBrI emulsion with 1.5 mole % iodide. The tabular grain population made up over 85% of the total projected area of the emulsion grains. The area weighted mean diameter was 3.4 micrometers. The average thickness determined from measurement of grain edges on scanning electron micrographs at 80,000× was 0.044 micrometers. This gave an aspect ratio of 77.

Comparison Example 6

To show the benefit of use of a triaminopyrimidine compound in acccordance with the invention, the example 2 emulsion make was repeated except that the triaminopyrimidine was omitted from the solutions. The area weighted diameter for the resulting emulsion was 2.94 micrometers and the thickness from SEM measurements was 0.0371 micrometers. The aspect ratio was 79.

Comparison Emulsion 7

To show the effect of higher pBr (preferred for the grain growth process of U.S. Pat. No. 5,411,851) during a double jet precipitation in the presence of a triaminopyrimidine grain growth modifier, the procedure of the Example 1 emulsion make were repeated except for the following changes: the addition of an NaBr solution before the first growth (after the heat rise to 60C) was omitted, and the pBr shift after the first growth brought the pBr to 3.38, which was then maintained for subsequent growth segments.

Less than 50% of the projected area of the total grain population exhibited tabular morphology, and the mean thickness of these tabular grains was 0.076 micrometers.

The invention has been described in detail with particular reference to certain preferred embodiments thereof, but it will be understood that variations and modifications can be effected within the spirit and scope of the invention.

What is claimed is:

1. A process for preparing an ultrathin high bromide {111} tabular grain silver halide emulsion in a reaction vessel comprising the steps of (a) forming in the presence of a dispersing medium a population of silver halide grain nuclei containing twin planes, and (b) growing the silver halide grain nuclei containing twin planes in the reaction vessel to form high bromide {111} tabular silver halide grains by the addition of silver and halide ions to the reaction vessel, WHEREIN the majority of the silver added to the reaction vessel during growth step (b) is added at a pBr of less than 2.6 and in the presence of a triaminopyrimidine grain growth modifier containing mutually independent 4, 5 and 6 ring position amino substituents, the 4 and 6 ring position substituents being hydroamino substituents.

2. A process according to claim 1, wherein the average grain thickness of the high bromide {111} tabular grains formed is less than 0.04 micrometers.

3. A process according to claim 1, wherein the average grain thickness of the high bromide {111} tabular grains formed is less than 0.03 micrometers.

4. A process according to claim 1, wherein the average aspect ratio of the high bromide {111} tabular grains formed is at least 80.

5. A process according to claim 1 wherein the triaminopyrimidine grain growth modifier satisfies the formula:

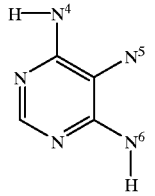

where $N^4$, $N^5$ and $N^6$ are independent amino moieties.

6. A process according to claim 5 wherein $N^4$ and $N^6$ represent primary or secondary amino groups and $N^5$ represents a primary, secondary or tertiary amino group.

7. A process according to claim 5 wherein the triaminopyrimidine satisfies the formula:

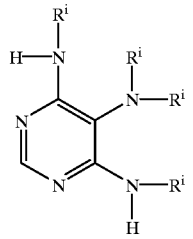

where $R^i$ is independently in each occurrence hydrogen or alkyl of from 1 to 7 carbon atoms.

8. A process according to claim 7 wherein $R^i$ is in each occurrence hydrogen.

9. A process according to claim 1 wherein the triaminopyrimidine is selected from among 4,5,6-triaminopyrimidine, 5,6-diamino-4-(N-methylamino)pyrimidine, 4,5,6-tri(N-methylamino)pyrimidine, 4,6-diamino-5-(N,N-dimethylamino)pyrimidine and 4,6-diamino-5-(N-hexylamino)pyrimidine.

10. The process of claim 1, wherein the population of silver halide grain nuclei formed in step (a) contains less than 0.6 percent by weight silver in the dispersing medium.

11. The process of claim 10, wherein the population of silver halide grain nuclei formed in step (a) contains less than 0.1 percent by weight silver in the dispersing medium.

12. A process according to claim 1 wherein the triamninopyrimidine is added to the reaction vessel prior to or during growth step (b) in an amount of 1 to 60 millimoles per total silver moles.

13. A process according to claim 1 wherein the triaminopyrimidine is added to the reaction vessel prior to or during growth step (b) in an amount of 5 to 40 millimoles per total silver moles.

14. A process according to claim 1 wherein the triaminopyrimidine is added to the reaction vessel prior to or during growth step (b) in an amount of 10 to 35 millimoles per total silver moles.

15. A process according to claim 1 wherein at least 50 percent of the triaminopyrimidine is added to the reaction vessel after 1–15 percent of the silver is added during growth step (b).

16. A process according to claim 1 wherein at least 50 percent of the triaminopyrimidine is added to the reaction vessel after 4–10 percent of the silver is added during growth step (b).

17. A process according to claim 1 wherein from 1–20 percent of the triaminopyrimidine is added to the reaction vessel prior to growth step (b), and the remainder is added during growth step (b).

18. A process according to claim 1 wherein the pBr is maintained between 1.5–2.6 during growth step (b).

19. A process according to claim 1 wherein the pBr is maintained between 1.7–2.1 during growth step (b).

20. An ultrathin high bromide {111} tabular grain silver halide emulsion obtained by the process of claim 1 wherein the average grain thickness of the high bromide {111} tabular grains formed is less than 0.03 micrometers and the average aspect ratio is greater than 80.

* * * * *